US010072370B2

(12) United States Patent
Kwon et al.

(10) Patent No.: US 10,072,370 B2
(45) Date of Patent: Sep. 11, 2018

(54) LAUNDRY TREATING APPARATUS AND METHOD FOR CONTROLLING THE SAME

(71) Applicant: LG ELECTRONICS INC., Seoul (KR)

(72) Inventors: Sunku Kwon, Seoul (KR); Sanghyun Lee, Seoul (KR); Bonkwon Koo, Seoul (KR); Sunho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 136 days.

(21) Appl. No.: 14/185,609

(22) Filed: Feb. 20, 2014

(65) Prior Publication Data

US 2014/0310883 A1 Oct. 23, 2014

(30) Foreign Application Priority Data

Apr. 17, 2013 (KR) ..... 10-2013-0042240

(51) Int. Cl.
*D06F 33/02* (2006.01)
*D06F 35/00* (2006.01)

(52) U.S. Cl.
CPC ..... *D06F 33/02* (2013.01); *D06F 35/005* (2013.01); *D06F 2202/12* (2013.01); *D06F 2204/065* (2013.01); *D06F 2204/084* (2013.01); *D06F 2204/086* (2013.01)

(58) Field of Classification Search
CPC ..... D06F 33/02
See application file for complete search history.

(56) References Cited

U.S. PATENT DOCUMENTS

2009/0183319 A1 7/2009 Chai et al.
2011/0099724 A1* 5/2011 Plata Amarillas ..... D06F 33/02 8/137
2015/0144734 A1 5/2015 Savian et al.

FOREIGN PATENT DOCUMENTS

DE 2704111 A1 8/1977
GB 1562777 A 3/1980

* cited by examiner

*Primary Examiner* — Jason Ko
(74) *Attorney, Agent, or Firm* — Dentons US LLP

(57) ABSTRACT

The present invention relates to a method for controlling a laundry treating apparatus including a washing course for eliminating dirt or contaminants from laundry loaded in a drum, a washing-dehydrating course for eliminating water elements from the laundry having the washing course by accelerating the drum; and a rinsing course performed after the washing-dehydrating course, the rinsing course for eliminating detergent used in the washing course and remaining dirt or contaminants of the laundry by rotating the drum, wherein the drum is decelerated down to a rinsing RPM higher than 0 RPM together with finishing of the washing-dehydrating course and the rinsing course starts at the rinsing RPM.

10 Claims, 5 Drawing Sheets

FIG. 3

| Course | Washing (S10) | Washing-dehydrating (S20) | | Rinsing (S40) | Rinsing-dehydrating (S50) |
|---|---|---|---|---|---|
| | | | Drainage (S30) | | |
| Drainage pump | OFF | OFF | ON | OFF | ON |

LAUNDRY TREATING APPARATUS AND METHOD FOR CONTROLLING THE SAME

Pursuant to 35 U.S.C. § 119(a), this application claims the benefit of earlier filing date and right of priority to Korean Application No. 10-2013-0042240, filed on Apr. 17, 2013, the contents of which are hereby incorporated by reference herein in their entirety.

BACKGROUND OF THE DISCLOSURE

Field of the Disclosure

The present invention relates to a laundry treating apparatus and a method for controlling the same.

Discussion of the Related Art

Typically, a laundry treating apparatus may be categorized into a washing machine (or a washer) and a dryer based on a function of treating laundry. A washing machine performs a washing course for eliminating dirt or contaminants from laundry, using washing water. A dryer performs a drying function for eliminating water elements contained in laundry. Recently, a washing machine having washing and drying functions after combining a washing machine with a dryer.

Meanwhile, the laundry treating apparatus may be categorized into a top loading type having a laundry introduction hole provided in a top of a cabinet and a front loading type having the laundry introduction hole provided in a front (or side) of a cabinet.

The top loading type washing machine includes a cabinet for defining an exterior appearance of the washing machine and a tub and a drum which are provided in the cabinet. In the top loading type washing machine, the drum and the tub are perpendicular to the ground and the drum is rotated on a shaft perpendicular to the ground. Also, a laundry introduction hole is provided in a top of the cabinet and a door is coupled to the top of the cabinet to open and close the laundry introduction hole.

In such the top loading type washing machine, a rotation number of the drum is maintained high through a dehydrating process. The drum might be rotated at a high rotation number in a state where laundry loaded in the drum is eccentric. In this instance, the eccentric laundry could make the drum collide with the tub and the cabinet while the drum is rotated at a high rotation number.

Generally, there is a natural frequency in a mechanism having a rotary element. Such a natural frequency is a unique property of the corresponding mechanism. In case an operating frequency of a rotary element is corresponding to the natural frequency, infinite vibration is generated theoretically. Such infinite vibration might deteriorate product reliability and cause damage and an error of the product. A user near the washing machine might be injured by the vibration.

A laundry treating apparatus performs a washing course for eliminating dirt or contaminants from laundry, a washing-dehydrating course for eliminating water element from the laundry after the washing course and a rinsing-dehydrating course for eliminating water element from the laundry after a rinsing course. In a conventional laundry treating apparatus, rotation of a drum is stopped together with finishing of the washing-dehydrating course and a drum re-operating course for performing a rinsing course is performed. A brake time is taken to stop the drum to finish the washing-dehydrating course and a predetermined time is taken to re-operate the drum to perform the rinsing course. The brake time and the drum re-operating time could increase an overall course time for treating laundry and also power consumption and electric charges. Frequent braking and re-operating of the drum might shorten a life of a driving motor.

SUMMARY OF THE DISCLOSURE

Exemplary embodiments of the present disclosure provide a laundry treating apparatus and a method for controlling the same which reduce the vibration generated by rotation of a drum.

Exemplary embodiments of the present disclosure provide a laundry treating apparatus and a method for controlling the same which can reduce an overall course time for treating laundry.

To achieve these objects and other advantages and in accordance with the purpose of the invention, as embodied and broadly described herein, a method for controlling a laundry treating apparatus includes a washing course for eliminating dirt or contaminants from laundry loaded in a drum; a washing-dehydrating course for eliminating water elements from the laundry having the washing course by accelerating the drum; and a rinsing course performed after the washing-dehydrating course, the rinsing course for eliminating detergent used in the washing course and remaining dirt or contaminants of the laundry by rotating the drum, wherein the drum is decelerated down to a rinsing RPM higher than 0 RPM together with finishing of the washing-dehydrating course and the rinsing course starts at the rinsing RPM.

The method for controlling the laundry treating apparatus may further include a drainage course performed during the washing-dehydrating course, the drainage course for draining washing water held in the drum by switching on a drainage pump.

Washing water and detergent may be provided to the drum during the washing course, and washing water may be provided to the drum during the rinsing course.

The rotation number of the drum may be maintained at the rinsing RPM while the rinsing course is performed.

The rinsing RPM may be higher than a horizontal resonance RPM which generates vibration in a vertical direction with respect to a shaft of the drum.

The rinsing RPM may be a value between a vertical resonance RPM which generates vibration in a direction to a shaft of the drum and a horizontal resonance RPM which generates vibration in a perpendicular to a shaft of the drum.

The rinsing course may include a water supplying step for spraying the washing water toward the drum, using a jet spray provided in a predetermined portion of a tub or a cabinet.

The water supplying step may be performed in predetermined periods or entire periods of the rinsing course.

The method for controlling the laundry treating apparatus may further include a rinsing-dehydrating course performed after the rinsing course, the rinsing-dehydrating course for eliminating water elements from the laundry having the rinsing course, wherein the rinsing-dehydrating course starts from a step of accelerating the drum from the rinsing RPM up to a preset RPM.

The RPM of the drum in the entire periods of the rinsing-dehydrating course may be higher than the RPM of the drum in the rinsing course.

The rinsing-dehydrating course may switch on a drainage pump to drain the washing water held in a tub out of the laundry treating apparatus.

In another aspect, a laundry treating apparatus includes a cabinet for defining a body thereof; a tub provided in the cabinet to hold washing water; a drum rotatably provided in the tub; a driving motor for rotating the drum; and a control unit for controlling the drum and the driving motor, wherein the control unit decelerates the drum down to a rinsing RPM higher than 0 RPM as a washing-dehydrating course for eliminating water elements from laundry by accelerating the drum is finished, and the control unit starts a rinsing course at the rinsing RPM.

The control unit may maintain the RPM of the drum at the rinsing RPM while rinsing course is performed.

The rinsing RPM may be higher than a horizontal resonance RPM which generates vibration in a horizontal direction with respect to a shaft of the drum.

The rinsing RPM may be a value between a vertical resonance RPM which generates vibration in a direction to a shaft of the drum and a horizontal resonance RPM which generates vibration in a perpendicular to a shaft of the drum.

The laundry treating apparatus may further include a jet spray for spraying washing water to the laundry inside the drum.

The jet spray may be provided in a predetermined portion of the tub or cabinet.

The jet spray may be provided in a predetermined upper portion of the tub or cabinet.

The jet spray may be configured to spray the washing water toward a lateral wall of a cylindrical drum.

The jet spray may be configured to spray the washing water toward a longitudinal center of a lateral wall of a cylindrical drum.

According to the embodiments of the present disclosure, the drainage course is performed during the dehydrating course, such that the vibration of the laundry treating apparatus generated by the rotating drum may be reduced advantageously.

Furthermore, the rinsing course is performed in the state where the drum is not stopped completely with the end of the dehydrating course, such that the overall course time taken to treat the laundry may be reduced advantageously.

Still further, the washing-dehydrating course is performed, without draining the washing water, such that the entangled laundry by the washing water may be prevented.

Still further, the eccentricity generated by the entangled laundry maybe prevented in the drum and the vibration generated by the eccentricity may be reduced advantageously.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

FIG. 3 is a block diagram schematically illustrating a method for controlling a laundry treating apparatus according to one embodiment of the disclosure;

DESCRIPTION OF SPECIFIC EMBODIMENTS

Figure 1:
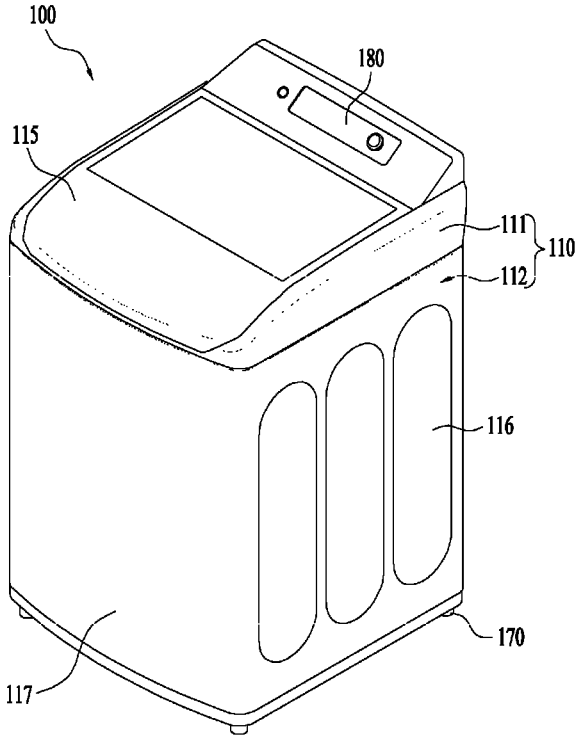
FIG. 1 is a perspective diagram illustrating an exterior appearance of a laundry treating apparatus according to one embodiment of the present disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein.

A laundry treating apparatus described hereinafter may be applied to all types of laundry treating apparatuses having a dehydrating function. A laundry treating apparatus according to exemplary embodiments of the disclosure may be a top loading type having a laundry introduction hole provided in a top of a cabinet to introduce laundry there through and a front loading type having a laundry introduction hole provided in a front (or a side) of a cabinet.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

Hereafter, a laundry treating apparatus according to exemplary embodiments of the disclosure is a top loading type washing machine. However, the laundry treating apparatus may be a front loading type washing machine. Also, the laundry treating apparatus according to the exemplary embodiments may be all types of laundry treating apparatuses having a dehydrating function including a dehydrator only having a dehydrating function and a dryer having a dehydrating function.

Figure 2:
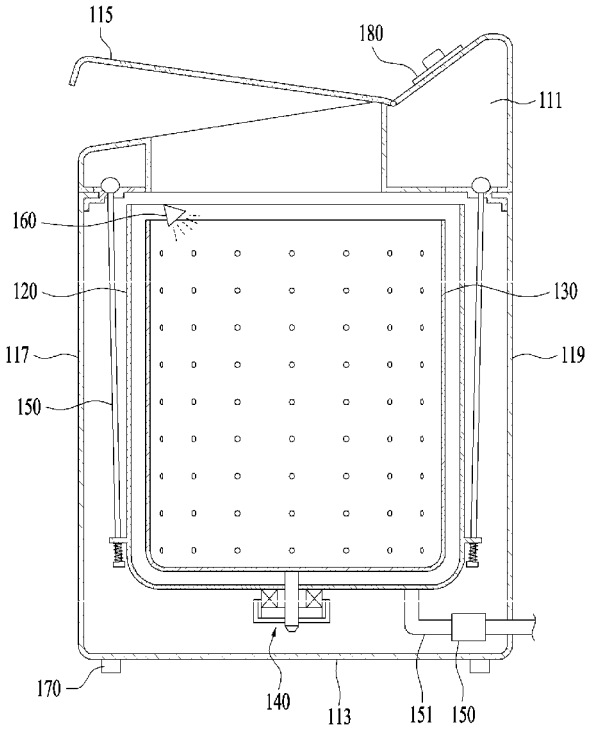
FIG. 2 is a sectional diagram illustrating an inner structure of a laundry treating apparatus according to one embodiment of the disclosure.

Referring to FIGS. 1 and 2, a washing machine 100 according to one embodiment of the disclosure may include a cabinet 110 defining a body of the washing machine. A tub 120 may be provided in the cabinet 110 and washing water is held in the tub 120.

A drum 130 is rotatably mounted in the tub 120 and a plurality of penetrating holes may be formed in the drum 130. A driving motor 164 is provided in a bottom of the tub 120 to rotate the drum. The tub 120 is supported to the cabinet 110 by a suspension system 125.

The cabinet 110 includes a lower cabinet 110 having an open tope and a top cover 111 coupled to the open top of the lower cabinet 110.

The lower cabinet 110 may include a side panel 116, a front panel 117, a base 113 and a back panel 119. At this time, the side panel 116, the front panel 117, the base 113 and the back panel 119 may be integrally formed as one body.

The top cover 111 may be coupled to the open top of the lower cabinet 110 and form a closed space where the ton 120 and the drum 130 are provided. A laundry introduction hole (not shown) is provided in the top cover 111.

A door 115 is provided in the top cover 111 and the door 115 opens/closes the laundry introduction hole. Also, a control panel 180 is provided in a predetermined portion of the top cover 115 to receive input a command for a washing course from a user. The user may control the washing machine through the control panel 180.

In other words, the user may select a washing course, start or end the washing course and control driving of the washing machine through an input unit (not shown) provided in the control panel 180. A leg 170 is provided in a back side of the bottom of the cabinet 110 to support the cabinet 110. The leg 170 may be provided underneath the base 113.

Meanwhile, the laundry treating apparatus according to the embodiment may include a drainage pump 150 to drain the washing water held in the tub and the drum outside the laundry treating apparatus.

The drainage pump 150 may be provided on a drainage passage 151 connected to a predetermined portion of the tub 120. The washing water held in the tub and the drum may be exhausted outside by the driving of the drainage pump 150.

The laundry treating apparatus according to the embodiment of the disclosure may include a jet spray 160 configured to spray washing water to the laundry loaded in the drum. The jet spray 160 may be provided in a predetermined portion of the tub 120, preferably, an upper portion of the tub 120. It is preferred that the jet spray 160 is an independent element from a water supply passage for supplying washing water to the tub 120.

The jet spray 160 is provided with the washing water from a water supply source to spray the washing water toward the laundry loaded in the drum. Especially, the jet spray 160 sprays the washing water on the laundry such that the washing water can be sprayed on the laundry uniformly advantageously. The jet spray 160 may be a nozzle type as a structure easy to spray the washing water.

In the embodiment mentioned above, the jet spray 160 is provided in the predetermined portion of the tub 120 and it is obvious that the jet spray 160 is provided in a predetermined portion of the cabinet. The jet spray 160 may be installed in a portion where the washing water is sprayed to the laundry inside the drum 130 easily and the portion is not limited necessarily.

Hereinafter, a method for controlling a laundry treating apparatus according to one embodiment of the disclosure will be described, referring to FIGS. 3 and 4.

The method for controlling the laundry treating apparatus may include a first course (S30) for rotating washing water and laundry inside a drum 130. Also, the method may include a drainage course (S30) for draining the washing water from the drum 130 and a first dehydrating course for eliminating water elements from the laundry inside the drum 130 by accelerating the drum 130, once the first course ends.

In this instance, the first course may be a washing course (S10) or a rinsing course (S40). Hereinafter, it is assumed that the first course is the washing course (S10). However, the embodiments of the disclosure may not exclude that the first course is the rinsing course (S40). In other words, the first course may be the rinsing course (S40) for eliminating detergent and remaining foreign matters contained in the laundry.

In case the first course is the washing course (S10), the first dehydrating course is a washing-dehydrating course (S20). The washing-dehydrating course (S20) is a course for eliminating the water elements contained in the laundry after the washing course (S10) ends. The washing-dehydrating course (S20) is distinguished from a rinsing-dehydrating course (S50) for eliminating water elements contained in the laundry after the rinsing course (S40) ends.

As mentioned above, it is not excluded that the first course is the rinsing course (S40). In case the first course is the rinsing course (S40), the first dehydrating course may be a rinsing-dehydrating course (S50).

The washing course (S10) is a course for eliminating dirt or contaminants from the laundry and it rotates the drum 130 to eliminate dirt from the laundry loaded in the drum 130.

In the washing course (S10), the drum 130 may be rotated in one direction or in clockwise/counter-clockwise directions alternatively. Also, in the washing course (S10), the drum 130 may be rotated intermittently or periodically. In other words, the drum 130 is intermittently rotated at a preset RPM and pauses. The drum 130 is re-rotated at a preset RPM.

In the washing course (S10), the drainage pump 150 maintains an OFF state. Before the washing course (S10) is performed, a water supplying course for supplying washing water to the tub 120 from a water supply source may be performed. The washing water may be held in the tub 120 in the water supply step.

In the water supplying course, detergent together with the washing water may be supplied to the tub 120. The detergent may promote an action of eliminating the dirt from the laundry. The driving of the drainage pump 150 in the washing course (S10) maintains an OFF-state such that the washing water supplied in the water supplying course may remain in the tub 120.

Once the washing course (S10) is performed, the driving motor 140 rotates the drum 130 and the washing water supplied to the tub 120 and the laundry held in the drum 130 are rotated together. The laundry may cause friction with the washing water in the washing course (S10), only to eliminate dirt or contaminants from the laundry.

Meanwhile, the washing course (S10) may be repeated several times according to a contamination level of the laundry. In this instance, the water supplying course is performed and the washing course (S10) is performed after that. Once the washing course (S10) ends, a drainage course for performing the next washing course (S10) starts.

The drainage course is for draining the washing water contaminated during the washing course (S10) and being supplied new clean washing water. Accordingly, when the washing course (S10) is performed several times, the washing supplying step, the washing course (S10) and the drainage step are repeated several times.

Although it will be described later, according to one embodiment of the disclosure, the drainage step is not performed after the washing course (S10) performed finally in case the washing course (S10) is performed several times.

In other words, the drainage step is not performed after the final washing course (S10) is performed. A washing course (S10) set which consists of the water supplying step, the washing course (S10) and the drainage step is repeated several times. A final washing course set performed finally may consist of the water supplying step and the washing course (S10).

The washing-dehydrating course (S20) is a course for eliminating water elements from the laundry held in the drum 130 once the washing course (S10) ends. In the washing-dehydrating course (S20), the drum 130 is rotated at a preset RPM and the water elements contained in the laundry are eliminated by a centrifugal force generated by the rotating drum 130.

The washing-dehydrating course (S20) is performed once the washing course (S10) is performed. The washing-dehydrating course (S20) may be performed right immediately after the washing course (S10) is performed or at preset time intervals.

When the washing course (S10) is converted into the washing-dehydrating course (S20), the drainage pump 150 maintains an OFF-state. Accordingly, the washing-dehydrating course (S20) starts in a state where the washing water used in the washing course (S10) remains in the tub, without being drained outside.

When the washing course (S10) is performed several times, the washing-dehydrating course (S20) is performed after the final washing course (S10).

Conventionally, the washing course (S10), the drainage course (S30) and the washing-dehydrating course (S20) performed sequentially. In other words, once the washing course (S10) is performed, the washing water used in the washing course (s10) is drained outside in the drainage course (S30) and then water elements are eliminated from the laundry in the washing-dehydrating course (S20). Once the washing course (S10) ends, the washing water is drained and distances between laundry items held inside the drum is getting narrow to layer laundry items. At this time, the washing-dehydrating course (S20) starts and a tension of the washing water possessed by the laundry could entangle the laundry items with each other.

In the embodiment of the disclosure, the washing-dehydrating course (S20) is performed after the washing course (S10) is performed completely, without the drainage course. The drainage course (S30) starts once the washing-dehydrating course (S20) starts.

Typically, there is a natural frequency in a mechanism having a rotary element. Such a natural frequency is a unique property possessed by a corresponding mechanism. In case an operating frequency of the rotary element is corresponding to the natural frequency, infinite vibration is generated theoretically. Such vibration might deteriorate product reliability and cause damage and errors of the product. Also, a user near the mechanism might get injured by the vibration.

Meanwhile, when vibration is generated, displacement is determined by various factors. Especially, the displacement is associated with a mass of a mechanism or product. As a mass of a mechanism (or product) is getting increased more and more, the displacement is getting decreased. As the mass of the mechanism (or product) is getting smaller, the displacement is getting increased.

In the embodiment of the disclosure, the washing-dehydrating course (S20) is performed, without draining the washing water after the washing course (S10). Accordingly, the displacement generated during the washing-dehydrating course (S20) may be reduced. Especially, the drainage course (S30) is performed, with maintaining a preset horizontal resonance RPM or more of the laundry treating apparatus, such that the displacement generated when the rotation number passes the horizontal resonance RPM may be reduced advantageously.

In the embodiment of the disclosure, the washing-dehydrating course is performed, without draining the washing water, such that the laundry can be prevented from getting entangled by the washing water. Specifically, the laundry can keep is floating in the washing water in a state where the washing water is not drained. When the washing-dehydrating course starts to perform in the state where the laundry is floating, the washing water may be dispersed in the drum and the tub uniformly by the centrifugal force. At this time, the laundry may be dispersed uniformly by the distribution of the washing water together. Accordingly, the laundry inside the drum may be prevented from getting entangled.

Moreover, the eccentricity of the laundry entangled in the drum may be prevented and the vibration generated by the eccentricity of the laundry may be reduced advantageously.

In one embodiment of the disclosure, the drainage course (S30) for draining the washing water from the drum 130 is performed during the washing-dehydrating course (S20). In other words, the drainage course (S30) is not performed before the washing-dehydrating course (S20) starts. The drainage course (S30) starts to perform after the washing-dehydrating course (S20) starts. Shortly, the drainage course (S30) is performed after the washing-dehydrating course starts. Here, starting of the drainage course (S30) means an operation for operating the drainage pump 160 initially. In other words, the starting of the drainage course (S30) means an initial operation of the drainage pump 160 after the washing course (S10). The drainage course (S30) is the course of switching on the drainage pump 150 and draining the washing water inside the tub 120 outside the laundry treating apparatus.

The drainage pump 150 may be initially driven while the washing-dehydrating course (S20) is performed. The initial driving of the drainage pump 150 means that the drainage pump 150 is initially driven during the washing-dehydrating course (S20) after the washing course (S10) is performed (the final washing course (S10) in case the washing course (S10) is performed several times.

In a time order, the end of the washing course (S10), the start of the washing-dehydrating course (S20) and the start of the drainage course (S30) are performed sequentially. Accordingly, the drainage pump 150 is driven in a preset time period after the washing-dehydrating course (S20) starts.

Specifically, the drainage pump 160 keeps an OFF-state while the washing course (S10) is performed. The drainage pump 160 may be initially driven (starts an ON state) in a preset time period after a starting point of the washing-dehydrating course (S20).

Meanwhile, when defining the method for controlling the laundry treating apparatus according to one embodiment of the disclosure with respect to the operation of the drainage pump 160, the washing-dehydrating course (S30) may include a first period in which the drainage pump 160 keeps an OFF state and a second period in which the drainage pump 160 keeps an ON state. The first period may start simultaneously with the start of the washing-dehydrating course (S30). Here, the second period is following the first period.

Figure 4:
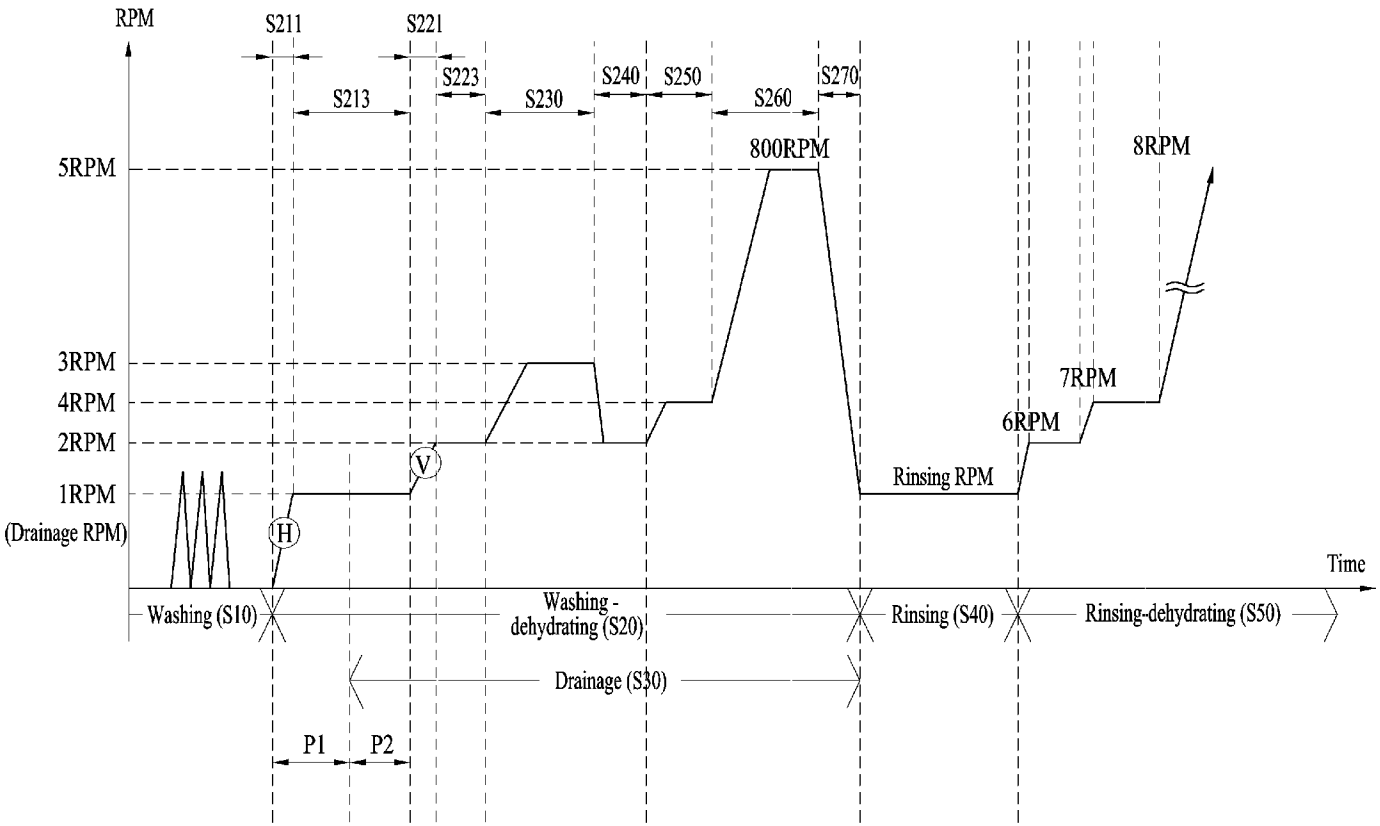
FIG. 4 is a graph illustrating change in rotation speeds of a drum according to a method for controlling a laundry treating apparatus according to one embodiment of the disclosure.
Figure 5:
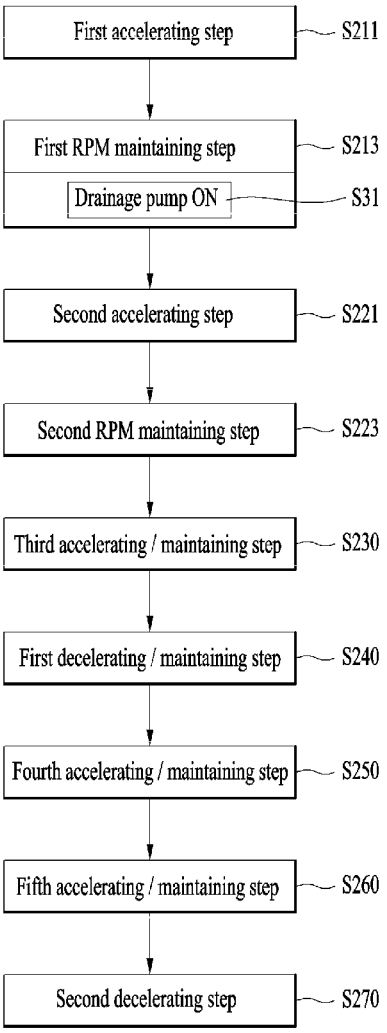
FIG. 5 is a flow chart illustrating a control flow of a washing-dehydrating course.

Referring to FIGS. 4 and 5, the washing-dehydrating course (S20) starts and the drum 130 is accelerated to reach a first RPM. Specifically, the washing-dehydrating course (S20) may include a first accelerating step (S211) for accelerating the paused drum 130 at the first RPM. The drainage course (S30) starts to perform at the first RPM and the first RPM may be defined as a drainage RPM.

It is preferred that the first drainage RPM is between a horizontal resonance RPM (H) and a vertical resonance RPM (V). Once the washing-dehydrating course (S20) starts to perform, the drum 130 is gradually accelerated up to the first RPM passing the horizontal resonance RPM. However, the drum 130 may be accelerated lower than the vertical resonance RPM as mentioned above.

Once the washing-dehydrating course (S20) starts, the drum 130 is accelerated up to the first RPM which is between the horizontal resonance RPM and the vertical resonance RPM.

According to one embodiment of the disclosure, the first RPM may be between 40 RPM and 270 RPM, preferably, 90 RPM and 140 RPM. It is more preferred that the first RPM is 120 RPM.

In case of the top loading type, the horizontal resonance RPM may be a value between 40 RPM and 270 RPM. The vertical resonance RPM may be a value between 140 RPM and 270 RPM.

Here, the horizontal resonance means the resonance in which the drum 130 is vibrating in a vertical direction with respect to a shaft of the drum 130. The vertical resonance means the resonance in which the drum 130 is vibrating in a direction horizontal to the shaft of the drum 130.

The first RPM at which the draining course (S30) is performed may be differentiated based on an amount of the laundry loaded in the drum 130 (hereinafter, the laundry amount). The first RPM is getting lower as the laundry amount is getting increased. The first RPM is getting higher, as the laundry amount is getting decreased.

When the laundry amount inside the drum 130 is large, the washing water contained by the laundry and the laundry amount inside the tub 120 are large. Once the drum 130 is rotated at a high rotation number in a state where the washing water inside the drum 120 is accommodated, the washing water inside the drum 130 might be overflowing.

Moreover, the washing water is pushed between the drum 130 and the tub 120 as the drum 130 is rotated. Accordingly, smooth rotation of the drum 130 fails to be performed smoothly.

When a large amount of laundry is loaded in the drum 130, it is necessary to control the first RPM at which the drainage course (S30) is performed. In this embodiment, when the laundry amount is large inside the drum 130, the first RPM is lowered to prevent the overflow of the washing water outside the drum 130 and the water concentration between the drum 130 and the tub 120 may be prevented.

When the laundry amount is small, the first RPM is increased and the overflow of the washing water and water concentration may be prevented. Simultaneously, the rotation number of the drum 130 which is a preset value or more RPM is secured to enable fast dehydration.

In one embodiment of the disclosure, the drainage curse (S30) may start to perform after the RPM of the drum 130 reaches the first RPM, in other words, after the drum 130 is accelerated to be the first RPM. The drainage course (S30) may be performed in the period in which the rotation number of the drum 130 is higher than the horizontal resonance RPM.

Specifically, the drainage course (S30) may start to perform in a preset time period after the washing-dehydrating course (S20) is performed. In other words, the drainage course (S30) starts to perform in a preset time period taken for the rotation number of the drum 130 to reach the first RPM.

Once the drum 130 is accelerated up to the first RPM, it is preferred that the drum 130 keeps the first RPM for a preset time period. In other words, the washing-dehydrating course (S20) may include a first RPM maintaining step (S213) of maintaining the rotation number of the drum 130 at the first RPM.

The first RPM maintaining step (S213) may include a preparing period (P1) for preparing the drainage course (S30) and a remaining water drainage period (P2) in which the drainage course (S30) is performed. As mentioned above, the drainage course (S30) may start to perform right after the rotation number of the drum 130 reaches the first RPM. In this instance, the preparing period (P1) may be omitted.

The drainage course (S30) may be performed in the period where the rotation number of the drum 130 is maintained at the first RPM. In other words, the drainage course (S30) may start (S31) in the first RPM maintaining step (S213) in which the rotation number of the drum 130 is maintained at the first RPM.

At this time, it is preferred that the drainage course (S30) is performed after the rotation number of the drum 130 is maintained at the first RPM for a preset time period. Specifically, the first RPM maintaining step may include a preparing step (P1) where the drum 130 is rotated at the first RPM for a preset time period in an off-state of the drainage pump 150.

The drainage course (s30) may start to perform right after the rotation number of the drum 130 reaches the first RPM. As mentioned above, it is preferred that the rotation number of the drum 130 is maintained at the first RPM for a preset time period.

Specifically, the drainage course (S30) may be performed after the preparing period (P1). Here, the time taken to perform the preparing period (P1) may be 3 seconds or 5 seconds, preferably, 4~5 seconds. Accordingly, the drainage course (S30) may be performed after the rotation number of the drum 130 is maintained at the first RPM for 4~5 seconds.

The drainage course (S30) may start after the preparing period (P1) of the first RPM maintaining step. Specifically, the drainage pump 150 is driven (S31) to perform the drainage course (S30) after the preparing period (P1). Here, the drainage pump 150 may be driven for the remaining water drainage period (P2) or more and it is preferred that the drainage pump 150 is driven in sequential accelerating steps S221, S223, S230, S240, S250, S260 and S270.

As mentioned above, the remaining water drainage period (P2) means the period in which the drainage pump 150 is switched on in the first RPM maintaining step (S213).

The remaining water drainage period (P2) may be changeable according to the laundry amount inside the drum 130. In one embodiment of the disclosure, the remaining water drainage period (P2) is in proportion to the laundry amount. In other words, as the laundry amount is getting larger, the time taken to maintain the remaining water drainage period (P2) is getting longer. As the laundry amount is getting smaller, the time taken to maintain the remaining water drainage period (P2) is getting shorter.

The remaining water drainage period (P2) is the period where water element contained in the laundry and water remaining in the tub 120 are drained in a state where the drum 130 is rotated at the first RPM. As the laundry amount is getting larger, the water elements contained in the laundry and the water remaining in the tub 120 are getting larger.

Accordingly, it is preferred that the maintaining time of the remaining water drainage period (P2) is increased as the laundry amount is larger and that the maintaining time of the remaining water drainage period (P2) is decreased as the laundry amount is smaller.

Once the first RPM maintaining period ends in the washing-dehydrating course (S20), the drum 130 is re-accelerated. At this time, the drum 130 may be accelerated in step by step. After the drum 130 is accelerated up to a preset RPM, the RPM is maintained for a preset time period and the drum 130 is re-accelerated, which is a profile type.

In one embodiment, the drum 130 may be accelerated over the vertical resonance RPM and until the rotation number of the drum 130 reaches a second RPM past a vertical resonance band. In other words, the washing-dehydrating course (S20) may include a second accelerating step (S221) of accelerating the drum 130 up to the second RPM.

The second RPM is a rotation number of the drum which is higher than the vertical resonance RPM. Once the rotation number of the drum 130 reaches the second RPM, the rotation number of the drum 130 is maintained at the second RPM for a preset time period. Specifically, the washing-dehydrating course (S20) may include a second RPM maintaining step (S223) of maintaining the rotation number of the drum at the second RPM for a preset time period.

After the second RPM maintaining step, a third accelerating/maintaining step (S230) starts to perform. In the third accelerating/maintaining step (S230), the drum 130 is re-accelerated up to a third RPM and the rotation number of the drum 130 is maintained at the third RPM for a preset time period.

The second RPM is corresponding to a range of RPMs past the vertical resonance RPM. In one embodiment, the second RPM may be 270 RPM. Alternatively, the second RPM may be 3 RPM and 450 RPM.

The drum 130 may be accelerated down to a second RPM after the drum 130 is accelerated up to a third RPM and the rotation number of the drum is maintained at the third RPM for a preset time period. Specifically, the washing-dehydrating course (S20) may include a first decelerating/maintaining step (S240). In the first decelerating/maintaining step (S240), the rotation number of the drum 130 is decelerated down to the second RPM and maintained at the second RPM for a preset time period.

After the first decelerating/maintaining step (S240), the drum 130 may be accelerated up to a fourth RPM and the rotation number of the drum 130 may be maintained at the fourth RPM. Specifically, the washing-dehydrating course (S20) may include a fourth accelerating/maintaining step (S250). In the fourth accelerating/maintaining step (S250), the fourth RPM may be between the second RPM and the third RPM. In one embodiment, the fourth RPM may be 400 RPM.

After the drum 130 accelerated up to the fourth RPM is maintained at the fourth RPM for a preset time period, the drum 130 may be accelerated up to a fifth RPM. In other words, the washing-dehydrating course (S20) may include a fifth accelerating/maintaining step (S260). At this time, the fifth RPM is over the third RPM. In one embodiment, the fifth RPM may be 800 RPM.

The washing-dehydrating course (S20) may include a second decelerating step (S260) of decelerating the rotation number of the drum to a preset RPM higher than 0 RPM from 5 RPM. As the second decelerating step (S260) is performed completely, the washing-dehydrating course (S20) ends. The preset RPM may be a rinsing RPM which will be described later.

The method for controlling the laundry treating apparatus may include a rinsing course (S40) and a rinsing-dehydrating course (S50). The rinsing course (S40) eliminates the detergent used in the washing course (S10) and dirt or contaminants remaining in the laundry.

The rinsing-dehydrating course (S50) eliminates water elements contained in the laundry after the rinsing course (S40). When the first course is the washing course (S10), the second course may be the rinsing course (S40). Also, when the second course is the rinsing course (S40), the second dehydrating course may be the rinsing-dehydrating course (S50).

In the conventional control method, the drum 130 stops completely, with the end of the washing-dehydrating course (S20). To perform the rinsing course (S40), the drum 130 is re-accelerated in a state where the drum 130 stops. However, the process of re-accelerating the drum 130 after stopping together with the end of the washing-dehydrating course (S20) requires a brake time for stopping the drum 130 and a re-driving time.

The brake time and the re-driving time happen to increase the overall course time for treating the laundry. Also, the brake time and the re-driving time increase the power consumption and electric charges. Frequent brake and re-operation of the drum 130 might reduce a life of the driving motor.

In one embodiment of the disclosure, the drum 130 is decelerated down to a rinsing RPM and stops, together with the end of the washing-dehydrating course (S20) performed before the rinsing course (S40). Here, the rinsing RPM is higher than 0 RPM. After the washing-dehydrating course (S20) ends, the drum 130 maintains a not completely stopping state.

Also, the rinsing course (S40) starts together with a step of maintaining the rotation number of the drum at the rinsing RPM. In other words, the rinsing course (S40) may be performed in a state where the rotation number of the drum 130 is maintained at the rinsing RPM. It can be said that the rinsing course (S40) starts at the rinsing RPM.

It can be said that the rinsing course (S40) starts from the operation for operating the drum at the rinsing RPM which is the RPM of the drum decelerated together with the end of the washing-dehydrating course (S20). The rinsing course (S40) rotates the drum 130 at the rinsing RPM to eliminate detergent and contaminants remaining in the laundry held in the drum 130.

In one embodiment of the disclosure, the washing-dehydrating course (S20) and the rinsing course (S40) may be performed serially in a state where the drum 130 is not stopped completely. When the rinsing course (S40) is performed in a state where the drum 130 is not stopped completely together with the end of the washing-dehydrating course (S20), the brake time and re-operating time required in the laundry treating apparatus may be reduced and the overall course time taken to treat the laundry may be reduced accordingly.

Moreover, the power consumption taken to treat the laundry may be reduced and the electric charges may be saved advantageously. Also, frequent brake and re-operation of the drum 130 may be prevented and a life of the driving motor may be extended.

In one embodiment of the disclosure, it is preferred that the rinsing RPM is higher than the horizontal resonance RPM. In case the drum 130 is decelerated down to a RPM lower than the horizontal resonance RPM with the end of the washing-dehydrating course (S20), the rotation number of the drum 130 passes the horizontal resonance RPM and the vibration of the tub 120 and the drum 130 may be amplified.

Accordingly, the RPM decelerated with the end of the washing-dehydrating course (S20) may be higher than the horizontal resonance RPM.

The rinsing RPM may be lower than the vertical resonance RPM. To suppress vibration, the rotation number of the drum 130 is decelerated down to a RPM higher than the vertical the vertical resonance RPM and then the rinsing course (S40) may be performed. However, the RPM higher than the vertical resonance RPM is relatively so high to perform the rinsing course (S40).

It is preferred that the rinsing RPM decelerated with the end of the washing-dehydrating course (S20) is between the horizontal resonance RPM and the vertical resonance RPM. In one embodiment of the disclosure, the rinsing RPM may be the same as the first RPM mentioned above in the washing-dehydrating course (S20).

Figure 6:
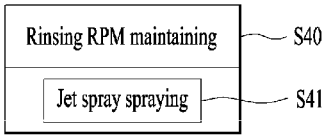
FIG. 6 is a block diagram illustrating a step of performing a rinsing cycle.

Referring to FIG. 6, the rinsing course (S40) may include a water supplying step (S41). Once the washing-dehydrating course (S20) is performed, a large amount of the water elements contained in the laundry loaded in the drum 130 is eliminated. To guarantee smooth performance of the rinsing course (S40) and to eliminate the remaining detergent and the remaining foreign matters effectively, the rinsing course (S40) may include a water supplying step (S410) of supplying washing water to the drum 130.

In one embodiment of the disclosure, the water supplying step (41) may be performed in a partial period of the rinsing course (S40) or an entire period of the rinsing course (S40). Also, the water supplying step (S41) may be performed by the jet spray 160 provided in the predetermined portion of the tub 120 or the cabinet.

Specifically, rinsing water is supplied to the drum 130 through the jet spray 160 in the water supplying step (S41). The jet spray 160 sprays the rinsing water on the laundry from an upper portion of the drum 130, such that the rinsing water can be supplied to the laundry uniformly.

Once the rinsing course (S40) is performed, the jet spray 160 is provided with the rinsing water from a water supply source and sprays the rinsing water into the drum 130. At this time, the jet spray 160 may spray the rinsing water in predetermined periods or entire periods of the rinsing course (S40).

Meanwhile, once performing the rinsing course (S40) completely, a rinsing-dehydrating course (S50) starts to perform. That is, the drum 130 is rotated at the rinsing RPM for a preset time period in the rinsing course (S40). When the rinsing course (S40) ends, the rinsing-dehydrating course (S50) starts to perform.

The drum 130 is rotated at the rinsing RPM in entire periods of the rinsing course (S40) and the drum 130 maintains the rotation at the rinsing RPM, with the end of the rinsing course.

The rinsing-dehydrating course (S50) starts a step of accelerating the drum from the rinsing RPM to a preset RPM. In other words, the rinsing-dehydrating course (S50) starts to accelerate the drum 130 at the rinsing RPM to eliminate the water elements from the laundry inside the drum. In the rinsing-dehydrating course (S50), the drum 130 has a continuously accelerating profile or gradually accelerating profile.

Meanwhile, the rotation number of the drum 130 is maintained at the rising RPM in the entire periods of the rinsing course (S40) according to the embodiment mentioned above. However, the embodiments of the present disclosure are not limited thereto. The RPM of the drum may be changed during the rinsing course (S50). In this instance, the RPM when the rinsing course (S40) ends may be different from the rinsing RPM. The rinsing-dehydrating course (S50) starts from a step of accelerating the drum from the RPM at the end of the rinsing course (S50). At this time, it is preferred that the ending RPM is higher than 0 RPM.

In one embodiment of the disclosure, the rinsing-dehydrating course (S50) has a gradually accelerated profile. Specifically, when the rotation number of the drum 130 reaches a preset RPM by accelerating the drum 130 for a preset time period, a period in which the preset RPM is maintained for a preset time period is provided and the drum 130 is re-accelerated up to a preset RPM higher than the preset RPM. As that process is repeated, the drum may be accelerated up to a final dehydrating RPM.

Referring to FIG. 5, the rinsing-dehydrating course (S50) may accelerate the drum 130 from the rinsing RPM up to a sixth RPM higher than the vertical resonance RPM. Also, the rinsing-dehydrating course (S50) may include a sixth RPM maintaining step of rotating the drum 130 at a sixth RPM for a preset time period. The sixth RPM may be the same as the second RPM of the washing-dehydrating course (S20).

After the sixth RPM maintaining step, the drum 130 is accelerated up to a seventh RPM. At this time, the rinsing-dehydrating course (S50) may include a seventh RPM maintaining step of rotating the drum 130 at a seventh RPM for a preset time period. At this time, the seventh RPM may be the same as the fourth RPM of the washing-dehydrating course (S20).

Once the seventh RPM maintaining step ends, the drum 130 may be accelerated up to an eighth RPM. At this time, the eighth RPM may be the maximum RPM of the rinsing-dehydrating course (S50). It is preferred that the eighth RPM is higher than the maximum RPM of the washing-dehydrating course (S20). In one embodiment, the eighth RPM may be 840 RPM.

The drum 130 accelerated up to the eighth RPM may be maintained at the eighth RPM for a preset time period. A step of decelerating the drum 130 rotating at the eighth RPM may start. The drum 130 may stop completely through the decelerating step. In other words, as the drum is decelerated down to 0 RPM from the eighth RPM, the rinsing-dehydrating course (S50) may end.

Meanwhile, the laundry treating apparatus according to one embodiment of the disclosure may include a control unit for performing control according to the method for controlling the laundry treating apparatus mentioned above. The control unit may implement the method for controlling the laundry treating apparatus mentioned above.

The disclosure may disclose the laundry treating apparatus including the control unit for performing the controlling method.

A laundry treating apparatus according to one embodiment of the disclosure includes a tub for holding washing water, a drum rotatably provided in the tub, a driving motor for rotating the drum and a control unit for controlling the drum and the driving motor. The control unit may accelerate the drum to perform a washing-dehydrating course for eliminating water elements from laundry and decelerate the drum down to a rinsing RPM higher than 0 RPM with the end of the washing-dehydrating course to start a rinsing course at the rinsing RPM.

Various variations and modifications of the refrigerator described above are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a laundry treating apparatus comprising:

a course determining an amount of laundry stored in a drum;

a water supplying course supplying washing water to a tub;

a washing course for eliminating dirt or contaminants from laundry loaded in the drum by rotating the drum located inside of the tub;

a washing-dehydrating course for eliminating water elements from the laundry having the washing course by accelerating the drum;

a drainage course for draining washing water held in the drum by switching on a drainage pump, the drainage course performed during the washing-dehydrating course; and a rinsing course performed after the washing-dehydrating course, the rinsing course for eliminating detergent used in the washing course and remaining dirt or contaminants of the laundry by rotating the drum, wherein the drum is decelerated down to a rinsing RPM higher than 0 RPM together with finishing of the washing-dehydrating course and the rinsing course starts at the rinsing RPM, wherein the washing-dehydrating course comprises:

a preparing step where the drum located inside of the tub containing the washing water accelerates in an off-state of the drainage pump up to a drainage RPM above a horizontal resonance RPM which generates vibration in a vertical direction based on the determined amount of laundry with respect to a shaft of the drum and keeps rotating at the drainage RPM in an off-state of the drainage pump, wherein the drainage course is performed after the preparing step, and wherein the drainage RPM is inversely proportional to the amount of laundry loaded in the drum.

2. The method for controlling the laundry treating apparatus according to claim 1, wherein washing water and detergent are provided to the drum during the washing course, and washing water is provided to the drum during the rinsing course.

3. The method for controlling the laundry treating apparatus according to claim 1, wherein the rotation number of the drum is maintained at the rinsing RPM while the rinsing course is performed.

4. The method for controlling the laundry treating apparatus according to claim 1, wherein the rinsing RPM is higher than a horizontal resonance RPM which generates vibration in a vertical direction with respect to a shaft of the drum.

5. The method for controlling the laundry treating apparatus according to claim 1, wherein the rinsing RPM is a value between a vertical resonance RPM which generates vibration in a direction to a shaft of the drum and a horizontal resonance RPM which generates vibration in a perpendicular to a shaft of the drum.

6. The method for controlling the laundry treating apparatus according to claim 1, wherein the rinsing course comprises a water supplying step for spraying the washing water toward the drum, using a jet spray provided in a predetermined portion of a tub or a cabinet.

7. The method for controlling the laundry treating apparatus according to claim 6, wherein the water supplying step is performed in predetermined periods or entire periods of the rinsing course.

8. The method for controlling the laundry treating apparatus according to claim 1, further comprising:

a rinsing-dehydrating course performed after the rinsing course, the rinsing-dehydrating course for eliminating water elements from the laundry having the rinsing course, wherein the rinsing-dehydrating course starts from a step of accelerating the drum from the rinsing RPM up to a preset RPM.

9. The method for controlling the laundry treating apparatus according to claim 8, wherein the RPM of the drum in the entire periods of the rinsing-dehydrating course is higher than the RPM of the drum in the rinsing course.

10. The method for controlling the laundry treating apparatus according to claim 8, wherein the rinsing-dehydrating course switches on a drainage pump to drain the washing water held in a tub out of the laundry treating apparatus.

* * * * *